US010807271B2

(12) United States Patent
Tsai

(10) Patent No.: US 10,807,271 B2
(45) Date of Patent: Oct. 20, 2020

(54) HOT KNIFE

(71) Applicant: GOODHOUSE Enterprise Co. Ltd., Taichung (TW)

(72) Inventor: Jung-Fa Tsai, Taichung (TW)

(73) Assignee: GOODHOUSE Enterprise Co., Ltd., Taichung (TW)

( * ) Notice: Subject to any disclaimer, the term of this patent is extended or adjusted under 35 U.S.C. 154(b) by 235 days.

(21) Appl. No.: 15/989,377

(22) Filed: May 25, 2018

(65) Prior Publication Data

US 2019/0358846 A1 Nov. 28, 2019

(51) Int. Cl.
*H05B 1/00* (2006.01)
*B26F 3/08* (2006.01)
*B26B 3/00* (2006.01)

(52) U.S. Cl.
CPC . *B26F 3/08* (2013.01); *B26B 3/00* (2013.01)

(58) Field of Classification Search
CPC ..... B26F 3/08; B26B 3/00; B26B 7/00
USPC ..... 219/200, 221, 225, 227, 228, 229, 230, 219/236, 237, 238
See application file for complete search history.

(56) References Cited

U.S. PATENT DOCUMENTS 3,970,816 A * 7/1976 Hosokawa ..... F01M 5/021 219/205
5,438,758 A * 8/1995 Roth-White ..... B26B 3/00 219/228
6,711,821 B1 * 3/2004 Clarke ..... B26B 3/00 30/140

* cited by examiner

*Primary Examiner* — Hung D Nguyen
(74) *Attorney, Agent, or Firm* — Alan D. Kamrath; Karin L. Williams; Mayer & Williams PC

(57) ABSTRACT

The present invention provides a hot knife, which includes a blade, a heat source, a handle, and a power source. The blade includes a central portion extending along a central axis, two wing portions integrally extending outwardly from two opposite sides of the central portion in a radial direction of the central axis, and a chamber defined by inner walls of the central portion and two wing portions. The heat source is disposed in the chamber and is adapted to supply heat to the blade. The handle is attached to the blade. The power source is disposed in the handle and is electrically connected to the heat source.

7 Claims, 3 Drawing Sheets

HOT KNIFE

BACKGROUND

The present invention relates to a heated cutting tool for cutting materials with a relatively low melting temperature.

A hot knife is a form of soldering iron equipped with a blade that is situated on a heating element. The blade of the hot knife can be heated to reach a high temperature by the heating element allowing for cutting materials with a relatively low melting temperature such as fabric, waxes, bars of soap, and foam materials without worry of fraying or beading.

However, the blade of the above hot knife is limited by the manufacturing method, the blade is thick, and the heat loss is large, resulting in poor efficiency and slow warm-up.

Thus, a need exists for a novel hot knife to mitigate and/or obviate the above disadvantages.

SUMMARY

A hot knife according to the present invention includes a blade, a heat source, a handle, and a power source. The blade includes a central portion extending along a central axis, two wing portions integrally extending outwardly from two opposite sides of the central portion in a radial direction of the central axis, and a chamber defined by inner walls of the central portion and two wing portions. The heat source is disposed in the chamber and is adapted to supply heat to the blade. The handle is attached to the blade. The power source is disposed in the handle and is electrically connected to the heat source.

In an example, the blade is shaped by punch pressing a metallic tube to form the central portion and the two wing portions.

In an example, the blade further includes a heat conductive insulation layer disposed in the chamber and in contact with an outer periphery of the heat source and the inner wall of the central portion.

In an example, the heat conductive insulation layer is formed by a high-temperature resistant ceramic paste.

In an example, a thickness of the central portion is greater than a thickness of each of the two wing portions.

In an example, two first rounded corners are formed at two connections between the central portion and each of the two wing portions. Two second rounded corners are formed at a terminal end of each of the two wing portions. A curvature of each of the two second rounded corners is greater than a curvature of each of the first rounded corners.

In an example, two flat surfaces are formed at two opposite sides of each of the two wing portions. Each of the two flat surfaces is located between each of the first rounded corners and each of the two second rounded corners.

In an example, the heat source in the chamber is a flexible heating element electrically insulated from the inner wall of the central portion by the heat conductive insulation layer.

In an example, the heat source in the chamber is an electric heating wire.

The present invention will become clearer in light of the following detailed description of illustrative embodiments of this invention described in connection with the drawings.

BRIEF DESCRIPTION OF THE DRAWINGS

The aforementioned and other aspects of the invention may best be understood by reference to the following description taken in conjunction with the accompanying drawings in which.

DETAILED DESCRIPTION

Figure 1:
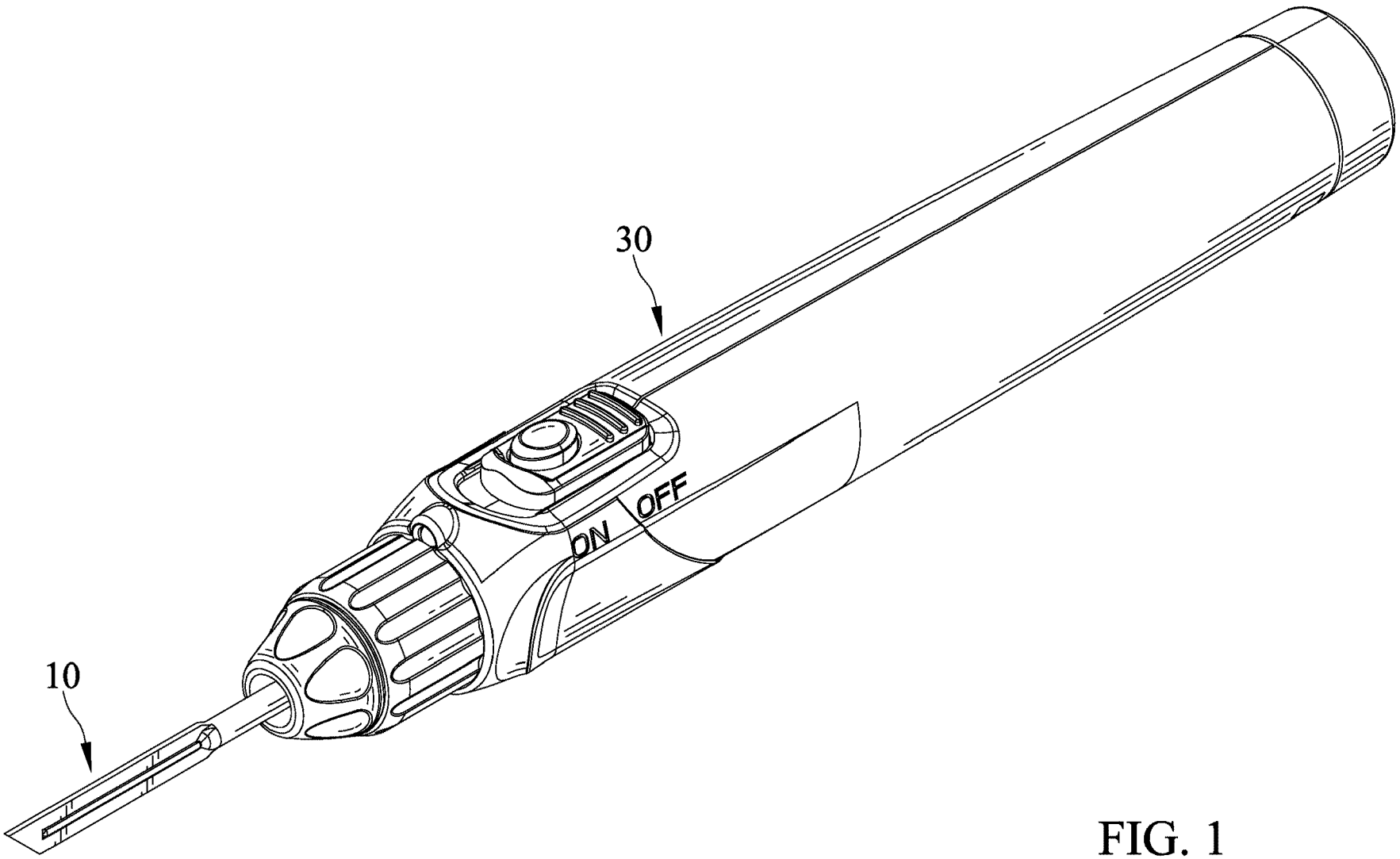
FIG. 1 is a perspective view of a hot knife according to the present invention.
Figure 2:
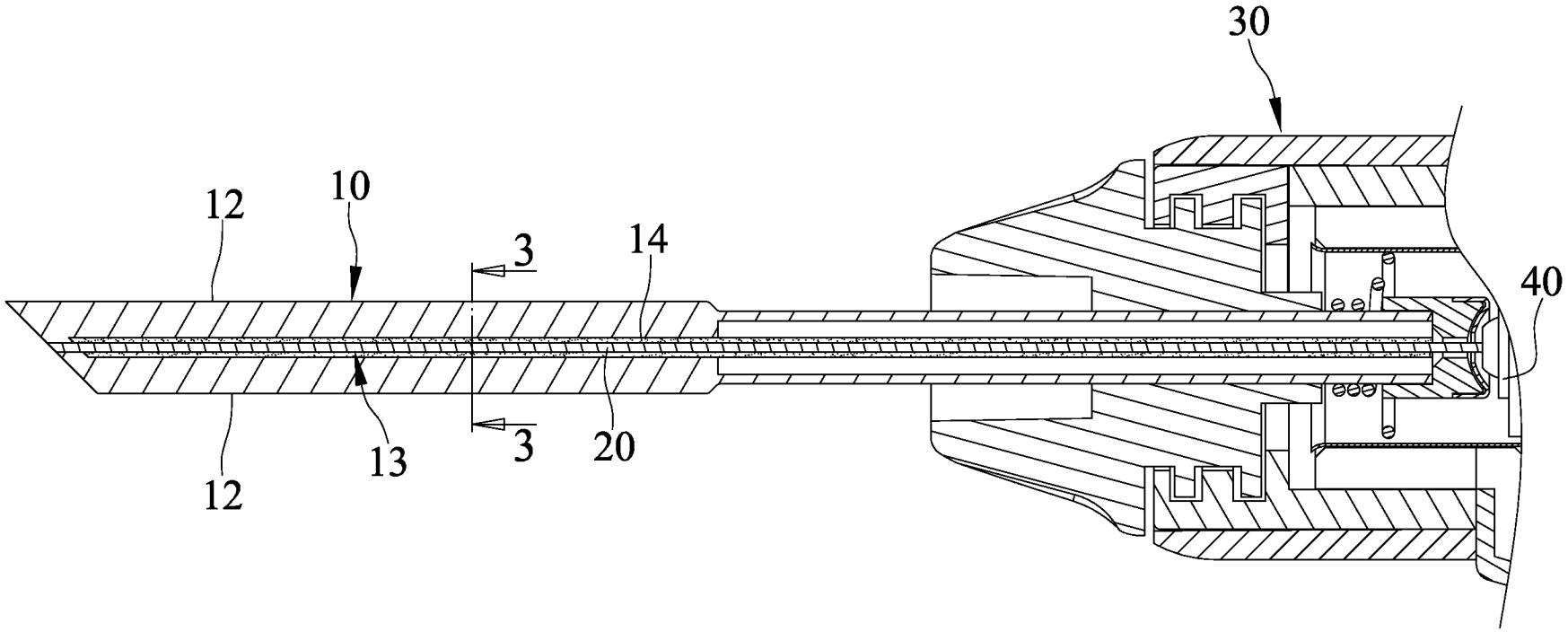
FIG. 2 is an exploded, partial cross-sectional view of the hot knife of FIG. 1.
Figure 3:
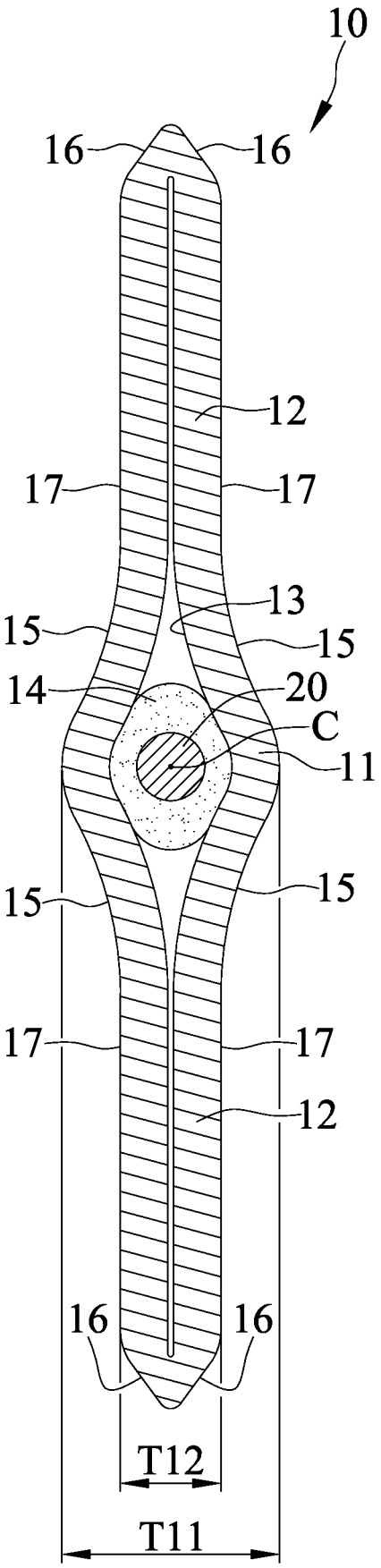
FIG. 3 is a cross sectional view taken along section line 3-3 of FIG. 2.

FIGS. 1-3 show a hot knife according to the present invention. The hot knife includes a blade 10, a heat source 20 disposed in the blade 10, a handle 30 attached to the blade 10, and a power source 40 disposed in the handle 30. The hot knife can be used to cut relatively low melting temperature materials after the heat source 20 raises the temperature of the blade 10 to a high temperature.

The blade 10 includes a central portion 11 extending along a central axis C, two wing portions 12 integrally extending outwardly from two opposite sides of the central portion 11 in a radial direction of the central axis C, and a chamber 13 defined by inner walls of the central portion 11 and two wing portions 12. A thickness T11 of the central portion 11 is greater than a thickness T12 of each of the two wing portions 12. The blade 10 further includes a heat conductive insulation layer 14 disposed in the chamber 13 and in contact with an outer periphery of the heat source 20 and the inner wall of the central portion 11.

Two first rounded corners 15 are formed at two connections between the central portion 11 and each of the two wing portions 12. Two second rounded corners 16 are formed at a terminal end of each of the two wing portions 12. A curvature of each of the two second rounded corners 16 is greater than a curvature of each of the first rounded corners 15.

Two flat surfaces 17 are formed at two opposite sides of each of the two wing portions 12, and each of the two flat surfaces 17 is located between each of the first rounded corners 15 and each of the two second rounded corners 16. Therefore, the two flat surfaces 17 are adapted for cutting materials with a relatively low melting temperature when the blade 10 is heated to reach a high temperature by the heating source 20.

In the embodiment, the blade 10 may be shaped by punch pressing a metallic tube such as galvanized iron tube to form the central portion 11, the two wing portions 12 integrally extending outwardly from the two opposite sides of the central portion 11, the two first rounded corners 15 formed at two connections between the central portion 11 and each of the two wing portions 12, the two second rounded corners 16 formed at a terminal end of each of the two wing portions 12, and the two flat surfaces 17 formed at two opposite sides of each of the two wing portions 12.

Therefore, the heat conductive insulation layer 14 may be formed by a high-temperature resistant ceramic paste with good thermal conductivity, providing electric insulation and high-temperature resistant.

The heat source 20 is disposed in the chamber 13 and is adapted to supply heat to the blade 10. In the embodiment, the heat source 20 may be a flexible heating element such as an electric heating wire electrically insulated from the inner wall of the central portion 11 by the heat conductive insulation layer 14.

The handle 30 is securely attached to the blade 10 to be gripped by a user.

The power source 40 is disposed in the handle 30 and is electrically connected to the heat source 20. The power source 40 may be supplied by conventional 110V alternating current or from a suitable direct current source. When power source 40 is applied to the heat source 20 within the blade 10, the blade 10 will heat up to a high temperature sufficient to melt the material with a relatively low melting temperature.

The blade 10 can be shaped by punch pressing a metallic tube. Therefore, the blade 10 is easy to manufacture with high production efficiency and reduces manufacturing costs. The thicknesses T12 of the two wing portions 12 are uniform. After the blade 10 is formed by punch pressing to form the central portion 11 and the two wing portions 12, the heat source 20 can be covered in the high-temperature resistant ceramic paste and then inserts into the chamber 13 to cause the heat conductive insulation layer 14 in contact with an outer periphery of the heat source 20 and the inner wall of the central portion 11 to conduct heat from the heat source 20 to the blade 10.

While various embodiments have been described above, it should be understood that they have been presented by way of example only, and not limitation. For example, any of the elements associated with the privacy summary may employ any of the desired functionality set forth hereinabove. Thus, the breadth and scope of a preferred embodiment should not be limited by any of the above-described exemplary embodiments.

What is claimed is:

1. A hot knife comprising:

a blade including a central portion extending along a central axis, two wing portions integrally extending outwardly from two opposite sides of the central portion in a radial direction of the central axis, and a chamber defined by inner walls of the central portion and two wing portions;

a heat source disposed in the chamber and adapted to supply heat to the blade;

a handle attached to the blade; and a power source disposed in the handle and electrically connected to the heat source, wherein the blade further includes a heat conductive insulation layer disposed in the chamber and in contact with an outer periphery of the heat source and the inner wall of the central portion, wherein two first rounded corners are formed at two connections between the central portion and each of the two wing portions, wherein two second rounded corners are formed at a terminal end of each of the two wing portions, and wherein a curvature of each of the two second rounded corners is greater than a curvature of each of the first rounded corners.

2. The hot knife as claimed in claim 1, wherein the blade is shaped by punch pressing a metallic tube to form the central portion and the two wing portions.

3. The hot knife as claimed in claim 2, wherein a thickness of the central portion is greater than a thickness of each of the two wing portions.

4. The hot knife as claimed in claim 1, wherein the heat conductive insulation layer is formed by a high-temperature resistant ceramic paste.

5. The hot knife as claimed in claim 1, wherein two flat surfaces are formed at two opposite sides of each of the two wing portions, and wherein each of the two flat surfaces is located between each of the first rounded corners and each of the two second rounded corners.

6. The hot knife as claimed in claim 1, wherein the heat source in the chamber is a flexible heating element electrically insulated from the inner wall of the central portion by the heat conductive insulation layer.

7. The hot knife as claimed in claim 1, wherein the heat source in the chamber is an electric heating wire.

* * * * *